US007966957B2

(12) United States Patent
Mack et al.

(10) Patent No.: US 7,966,957 B2
(45) Date of Patent: Jun. 28, 2011

(54) MAGNETIC FABRIC RETAINING DEVICE

(75) Inventors: Charles H. Mack, West Bend, WI (US); Jesse C. Mack, Slinger, WI (US)

(73) Assignee: Midwest Products, Inc., Germantown, WI (US)

( * ) Notice: Subject to any disclaimer, the term of this patent is extended or adjusted under 35 U.S.C. 154(b) by 383 days.

(21) Appl. No.: 12/217,689

(22) Filed: Jul. 8, 2008

(65) Prior Publication Data

US 2008/0276849 A1 Nov. 13, 2008

Related U.S. Application Data

(63) Continuation-in-part of application No. 12/072,775, filed on Feb. 28, 2008, now Pat. No. 7,607,399.

(60) Provisional application No. 60/903,997, filed on Feb. 28, 2007.

(51) Int. Cl.
*D05C 9/04* (2006.01)
*D05B 39/00* (2006.01)

(52) U.S. Cl. ..... 112/103

(58) Field of Classification Search ..... 112/103, 112/470.06, 470.14, 470.18; 38/102.2, 102.91
See application file for complete search history.

(56) References Cited

U.S. PATENT DOCUMENTS

| | | | | |
|---|---|---|---|---|
| 3,664,288 | A * | 5/1972 | Weidlin Von Boden et al. | 112/103 |
| 4,834,006 | A | 5/1989 | Goto | |
| 5,138,960 | A | 8/1992 | Inteso | |
| 5,353,725 | A | 10/1994 | Sakakibara | |
| 5,509,367 | A | 4/1996 | Conley, Jr. | |
| 5,842,430 | A | 12/1998 | Mack | |
| 5,920,139 | A | 7/1999 | Fujiwara et al. | |
| 5,934,210 | A | 8/1999 | Lucchese | |
| 5,970,895 | A | 10/1999 | Mack | |
| 5,992,339 | A | 11/1999 | Mack | |
| 6,240,863 | B1 | 6/2001 | Vickroy et al. | |
| 6,336,416 | B1 | 1/2002 | French et al. | |
| 6,394,012 | B1 | 5/2002 | French et al. | |
| 6,457,428 | B1 | 10/2002 | Vickroy | |
| 6,679,190 | B1 | 1/2004 | French et al. | |
| 7,194,967 | B2 | 3/2007 | Bowlus | |
| 7,255,052 | B2 | 8/2007 | Okazaki | |
| 7,357,088 | B1 | 4/2008 | Bowius | |
| 7,484,466 | B2 * | 2/2009 | Kuki et al. | 112/103 |
| 7,506,596 | B2 * | 3/2009 | Bowlus | 112/103 |
| 7,607,399 | B2 * | 10/2009 | Mack et al. | 112/103 |
| 2005/0178031 | A1 | 8/2005 | Fabec | |
| 2006/0272565 | A1 | 12/2006 | Bowlus | |
| 2006/0278148 | A1 | 12/2006 | Lord et al. | |
| 2008/0141915 | A1 | 6/2008 | Bowius | |

FOREIGN PATENT DOCUMENTS

| | | |
|---|---|---|
| JP | 03-130456 | 6/1991 |

(Continued)

*Primary Examiner* — Ismael Izaguirre
(74) *Attorney, Agent, or Firm* — Ryan Kromholz & Manion, S.C.

(57) ABSTRACT

A device for use with an embroidery machine to hold an item or material to be embroidered between upper and lower hooping members, with the hooping members being secured to one another by use of a magnetic force, preferably with rare earth magnets, is disclosed. The magnets provide a solid, secure mating arrangement between the upper and lower hooping members without the need to adjust for different thicknesses of material. Compressible and/or frictional material may be attached to at least one hooping member to securely retain the item or material to be embroidered. One hooping member has interchangeable arms for attaching the mating hooping members to different brands of embroidery machines. One hooping member may also include a locating device for attaching the hooping members to a hooping device such as a hooping board.

17 Claims, 6 Drawing Sheets

FOREIGN PATENT DOCUMENTS

| | | |
|---|---|---|
| JP | 11-001860 | 1/1999 |
| JP | 411061627 A | 3/1999 |
| JP | 11-181666 | 7/1999 |
| JP | 2002-078996 | 7/1999 |
| JP | 2005-146460 | 6/2005 |
| JP | 2006-052496 | 2/2006 |

* cited by examiner

MAGNETIC FABRIC RETAINING DEVICE

RELATED APPLICATIONS

This is a continuation-in-part patent application of U.S. patent application Ser. No. 12/072,775, filed on 28 Feb. 2008, now U.S. Pat. No. 7,607,399 which claims the benefit of U.S. Provisional Patent Application Ser. No. 60/903,997, filed on 28 Feb. 2007.

BACKGROUND OF THE INVENTION

The present invention relates to the field of embroidery and monogramming and more specifically to a hoop that incorporates magnets to hold and secure a garment, piece of material, or other item to be embroidered.

In the embroidery industry "hoop" or "hoops" are referred to by many different terms, like frame, clamp, hooping device, fabric holding device, fabric retaining device and fabric mounting frame. The definition of each of these terms is intended to apply to all of these terms to give these terms their broadest meaning individually and collectively as they are used interchangeably herein. In an instance where the term or terms have more than one meaning, all meanings will apply.

Various types of hoops and frames for holding an item to be embroidered are commonplace for both home embroidery and commercial embroidery machines. Generally, embroidery hoops comprise upper and lower hoops or clamping members that mate with one another. Clothing is placed between the clamping members, usually with a backing material also placed between the lower member and the item to be embroidered. These types of hoops tightly pinch the material between the vertical sides of the upper and lower hoops. Because of this, the lower hoop member needs to be adjusted for any change in thickness of the item to be hooped, which may not always result in the material being sufficiently taut or tight, potentially resulting in an improperly embroidered piece of material.

The use of standard embroidery hoops becomes more difficult when the item to be embroidered is a heavier or thicker material, such as a winter jacket, work overalls, Carhartt® type jackets, or items made of leather. Properly embroidering such items can be very difficult and time consuming. It is very difficult to figure out what adjustment should be made to the lower hoop or clamping member to securely hold the garment, while not having too tight of an arrangement that the two clamping members cannot properly mate with one another. It often takes multiple tries to get the adjustment correct. Some fabrics, like that of Carhartt® type jackets, are not made to be stretched or formed in a manner needed to allow standard hoops to be applied to the fabric, so it requires application of a great deal of pressure to try to make the fabric conform to the shape of the hoop.

U.S. Pat. No. 6,336,416 illustrates a clamp style prior art type of hoop or frame that was designed to overcome some of these obstacles. This type of frame does not need to pinch the fabric between vertical edges on its body, so this frame can hold various thicknesses of fabric much easier. It pinches the material between the faces of its upper clamping member and lower clamping member. These clamping members are spring loaded to allow for different thickness of material to be held without adjustment, but they do have limitations. Because of the need for a pivot point and at least one spring for biasing the base plate and upper clamping member in closed contact, the maximum sewing area of the embroidery machine is further limited by this prior art space requirement.

Prior art clamps are typically made out of steel to make them rigid enough to perform their intended operation. Such rigid material, and the extra mechanism needed for the pivot point and spring bias, makes the clamps heavier than standard hoops, with the added weight applying unnecessary stress to the mechanical and electrical components of the embroidery machine. The physical size of the clamp can also cause damage to some embroidery machines if the entire body of the clamp cannot fit under the needle bars used for embroidery. Operators need to be careful not to move the machine to a position that the body of the clamp can contact the needle bars.

U.S. Pat. Nos. 6,240,863 and 6,394,012 illustrate an alternative hoop or frame, created to address the limitations of standard upper and lower hoop members. These frames are designed to hold a special type of sticky backing material. The garment is then placed over and adhered to the sticky material to hold it in place while the embroidery operation is performed. This type of frame is very good for getting into small areas like pockets on garments, or for sewing on delicate fabrics, but is not really designed for everyday normal hooping of garments; it is more for specialty items. One disadvantage to these frames is the need for special sticky backing, which is generally more expensive than standard backing and can leave a residue on the needles of the embroidery machine over time. The residue can cause increased thread breaks and other problems. Also, the backing material has a limited number of uses before it needs to be removed from the frame and a new piece applied, which can increase the production time needed to complete a job. The sticky backing is not strong enough to adequately hold heavy items like Carhartt® type jackets during the embroidery process. The extra expense and increase in production time that is created by the use of sticky backing makes the sticky backing type of frame impractical for most normal placements of designs on shirts and jackets.

U.S. Pat. No. 5,138,960 discloses a magnetic monogramming frame. This frame is designed to be mounted to the pantograph of an embroidery machine from its lower member. The pantograph of the machine is the part that holds and moves the embroidery hoop under the stationary needle to create the design. Mounting a hoop directly to the pantograph requires that you physically fasten the hoop to the pantograph or that you fasten a separate adapter directly to the pantograph. Newer style machines use a set of arms that extend out from the pantograph and have adaptors on the ends of the arms that allow for quicker and easier mounting of hoops. The hoop from this prior art device is not designed to be releasably mounted to the existing hoop holding arms on these newer style commercial embroidery machines. This outdated design increases the time it takes to switch from using one type of frame to another. The frame of this prior art device pinches the material directly between the magnetic material. This prior art frame does not incorporate a special compressible material to allow it to hoop uneven or thick items. This prior art frame also does not allow for the controlling of when the upper and lower members will be attracted to each other.

It is also desirous to improve and simplify the hooping process, in general. Hoops used in the commercial market must be suitable for repetitive, quick and accurate processes. That is, the devices must be set-up quickly for each successive embroidered piece of material, which requires that the hoop will sufficiently hold the fabric securely in place, in a manner that can be accomplished quickly and efficiently. When embroidering, there is generally a backing piece of fabric located below the piece of clothing to be embroidered. Both the backing material and the item to be embroidered should be sufficiently held in place and not be allowed to move during the embroidery process, once properly aligned.

Present hoops leave room for improvement, as noted above. It would be desirable to have a hoop that would not have to be adjusted for different thicknesses of materials and would not require a great amount of force to apply it to thick materials. It would also be desirable to be able to hold a large area of material to be embroidered without the embroidery hoop or clamping members limiting the potential sewing area of the embroidery machine, or adding an excessive amount of weight that the machine will have to move during the embroidery process. Another improvement would be to have a hoop that was easy to quickly align and apply to different types of garments.

SUMMARY OF THE INVENTION

The present invention provides a hoop used with embroidery machines that is easy to apply to garments and align during the hooping process. The device generally comprises upper and lower clamping members, with the clamping members being secured to one another by use of a magnetic force, preferably with rare earth magnets. The magnets provide a solid, secure mating arrangement between the upper and lower clamping members.

The magnets may be arranged in numerous configurations on the members. For example, one of the hooping members could include magnets while the other member would include or be fabricated from metal or there could be magnets on both members. The number of magnets on each member could be altered as well, preferably with the arrangement of the magnets on the members being generally the same between the upper and lower members. The magnets could be arranged so that the lower hoop has all of one pole facing the upper hoop and the upper hoop has the opposite poles facing the lower hoop, or the magnets could alternate on each of the members. The upper member may also incorporate an actuatable biasing means that will keep the magnets biased away from the upper member so that this bias needs to be overcome before the upper and lower members will be attracted to each other. The use of a switchable magnet like the device described in U.S. Pat. No. 6,707,360 B2 may also be used so that the exact time that the upper and lower members attract to each other can be controlled.

The lower clamping member may also be a shape that would align itself with a hoop holding bracket or device on a hooping board to assist in proper alignment of the hoop with an item to be embroidered. Alignment could also be accomplished in other manners, such as a pin in the hoop holding bracket and a corresponding hole in the lower hoop member, or the opposite arrangement. The lower clamping member could also have pins or another locating means in it to hold it directly to a hooping board without the need for any additional bracket. This is to make it easier to help properly align the clamping members with a piece of material or garment to be embroidered. There could also be a non-slip material like rubber or sandpaper adhered to one or both of the mating surfaces to help hold the article to be embroidered.

The hoop may have a compressible material attached to the underside of the upper member to assist in gripping the material that is placed between the clamping members. This compressible material also helps when embroidering items with seams and other uneven surfaces.

The hoop according to the present invention may further incorporate a hinge connecting the upper and lower clamping members together. The above noted magnets are attached to the upper and lower clamping members as described. In a preferred embodiment, the magnets are located on the side opposite the hinge or hinges. However, the magnets could be placed on any side or adjacent to the hinge or hinges.

The hoop of the present invention does not need a biasing spring by the hinge or pivot point so the sewing area is not reduced. As the strength of the selected magnet or magnets is sufficiently strong, the hoop is effective at holding various types and thicknesses of garments. By comparison, a hoop utilizing springs near the hinge or pivot point may not be sufficiently strong enough to retain a thick or heavy garment. In addition, the material from which the hoop is made must be rigid enough in combination with the spring to hold the hoop in a closed position. Conversely, the hoop of the present invention can be made from lightweight materials since the magnets are holding the upper and lower members together and are ideally farther from the hinge or pivot point.

These and other features of the device will become evident with respect to the drawings and the detailed description.

DESCRIPTION OF THE PREFERRED EMBODIMENT

Although the disclosure hereof is detailed and exact to enable those skilled in the art to practice the invention, the physical embodiments herein disclosed merely exemplify the invention which may be embodied in other specific structures. While the preferred embodiment has been described, the details may be changed without departing from the invention, which is defined by the claims.

Figure 1:
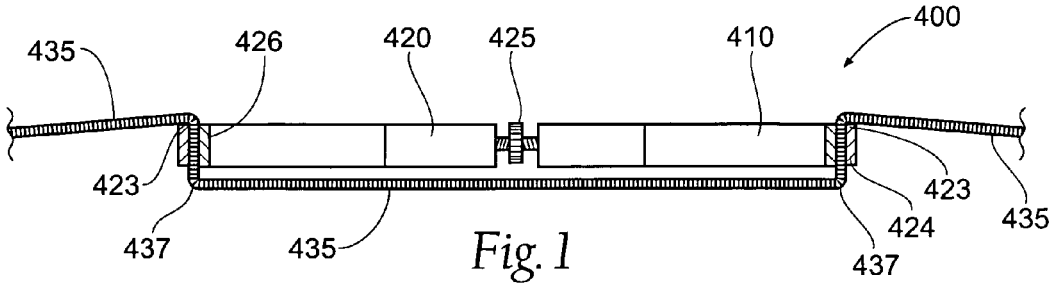
Fig. 1 PRIOR ART
FIG. 1 shows a side view of a prior art embroidery hoop with a piece of material secured between the upper and lower hoops.
Figure 2:
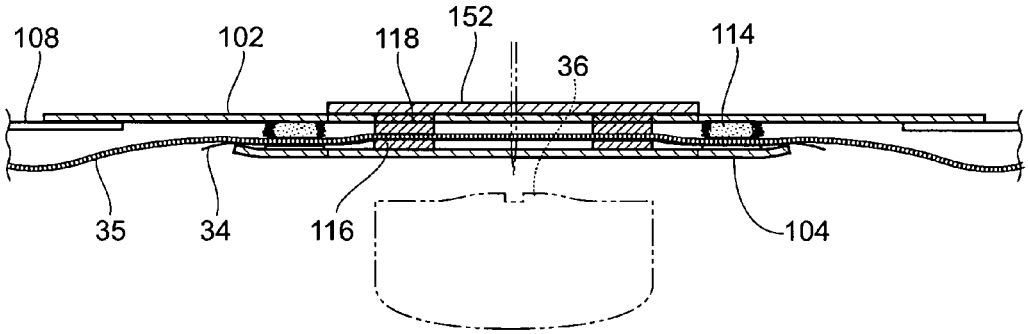
FIG. 2 is a side view of a hooping member according to the present invention with a piece of material secured between the upper and lower clamping members.

The present invention provides a hoop used with embroidery machines that is easy to apply to garments of varying thickness and align during the hooping process. Likewise, alignment can be accomplished quickly and efficiently, regardless of the thickness of the material being placed within the hoop, without distorting the area that embroidery is being placed upon. FIGS. 1 and 2 compare differences in securing material according to the prior art with the present invention. FIG. 1 demonstrates the prior art, while FIG. 2 provides an arrangement according to the present invention.

FIG. 1 shows a side view of a prior art embroidery hoop 400 with a piece of material 435 secured between the upper and lower clamping members 410 and 420. 437 and 423 demonstrate the sharp angle that the standard hoop 400 forms, for which the material 435 must conform so that the male hoop member 410 and female hoop member 420 can hold the material 435. The material 435 is pinched between the inner surface of member 420 shown at 424, and the outer surface of ridge 426 of clamping member 410. Each time the thickness of material 435 is changed, adjustment to the female member 420 needs to be made with adjuster 425 so that the hoop sufficiently retains the material 435. Such an arrangement allows room for error in that the material 435 may not be sufficiently taut for each future use, which can lead to improperly embroidered materials. It is also common for this type of hoop to damage the fabric it is holding, especially with such a severe angle being formed in the material. If the adjustment on the lower hoop is just a little too tight when the two clamping members are pressed together, the fibers of the fabric will be permanently damaged. This is referred to in the industry as "hoop burn."

As shown in FIG. 2, the present invention does not need to form the material into tight bends to hold it. The compressible material 114 of the upper member 102 holds the material to be embroidered against the lower member 104 and takes up any difference in thickness of the material. The magnets 118 and 116 provide the force to hold the upper and lower members together.

FIG. 2 shows a side view of upper clamping member 102 and lower clamping member 104 holding a piece of material 35 and backing material 34 in place for embroidering purposes. Magnets 118 and 116 provide the holding force to securely keep material 35 and 34 pinched between the compressible material 114 of the upper member 102 and lower member 104. When the thickness of material 35 changes, compressible material 114 compresses to take up the difference in thickness and securely retain material 35.

Figure 3:
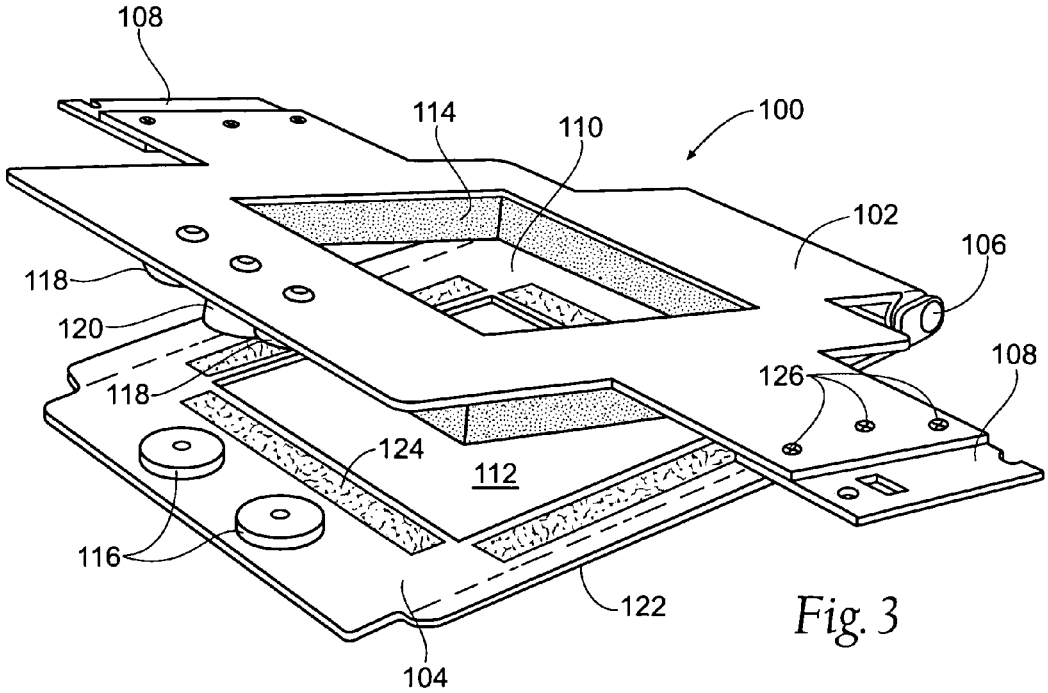
FIG. 3 shows one embodiment in accordance with the present invention.

FIG. 3 is a perspective view of one form of the present invention. The magnetic clamp 100 is comprised of the following. The upper clamping member 102 and lower clamping member 104 have a generally similar shape with an opening 110 in the upper clamping member and opening 112 in the lower clamping member being designed to mate when the members are biased together. These openings 110 and 112 form the area where the material to be embroidered will be situated. The upper clamping member 102 supports magnets 118, which are preferably rare earth style metals. The magnets 118 are preferably symmetrically arranged on the side opposite from the hinge or pivot point 106. Magnets could also be alternatively placed along the sides of the upper clamping member 102 adjacent to the hinge or pivot point 106. The lower member 104 supports magnets 116, which are designed to mate with the magnets 118 and are of an opposite magnetic pole than corresponding magnets 118. Magnets 116 on the lower member could also be replaced with a metal plate (not shown) to attract to magnets 118 of the upper member, or the lower member 104 could be made out of a metallic material that would be attracted to magnets 118 of the upper member. The clamping member can be held in place on an embroidery machine (not shown) by way of oppositely disposed arms 108. The mounting arms 108 can be easily interchanged to fit different models of automated embroidery machines. Removable fasteners 126 hold mounting arms 108 to the main body of upper member 102. The simple changing of these disposed arms 108 can make the rest of the clamp universally fit many brands of embroidery machines. It should be understood that any shape or design of an arm that will allow a hoop to be properly mounted will fall within the scope of the present invention.

The upper clamping member 102 also has a compressible type of material (such as foam rubber) 114 attached to the underside of the upper clamping member 102. This foam 114 is used to secure the material (not shown) between the upper clamping member 102 and the lower clamping member 104. This foam 114 is what allows the clamp to hold items with zippers, seams, and other uneven thicknesses. Spacer 120 is used to hold the upper magnets 118 and lower magnets 116 from coming into direct contact with each other if the clamp is closed without material in-between. The lower member 104 could also be a shape that would align itself with a hoop holding bracket or device on a hooping board to assist in proper alignment of the hoop with an item to be embroidered. This alignment could also be accomplished by another method such as a pin in the hoop holding bracket and a corresponding hole in the lower clamping member 104, or the opposite (not shown). The lower clamping member 104 could also have pins or another locating means in it to hold it directly to a hooping board without the need for an additional bracket. A rubber gasket, sandpaper, or the like 124 could be placed on the upper surface of the lower clamping member 104 adjacent to opening 112 to provide added friction when securing pieces of material, but it is not necessary. The side edges 122 of the lower clamping member 104 can be bent slightly upward towards the upper clamping member 102 to help provide friction on the item to be secured in the clamp. These ridges also add strength to the lower clamping member 104.

Figure 4:
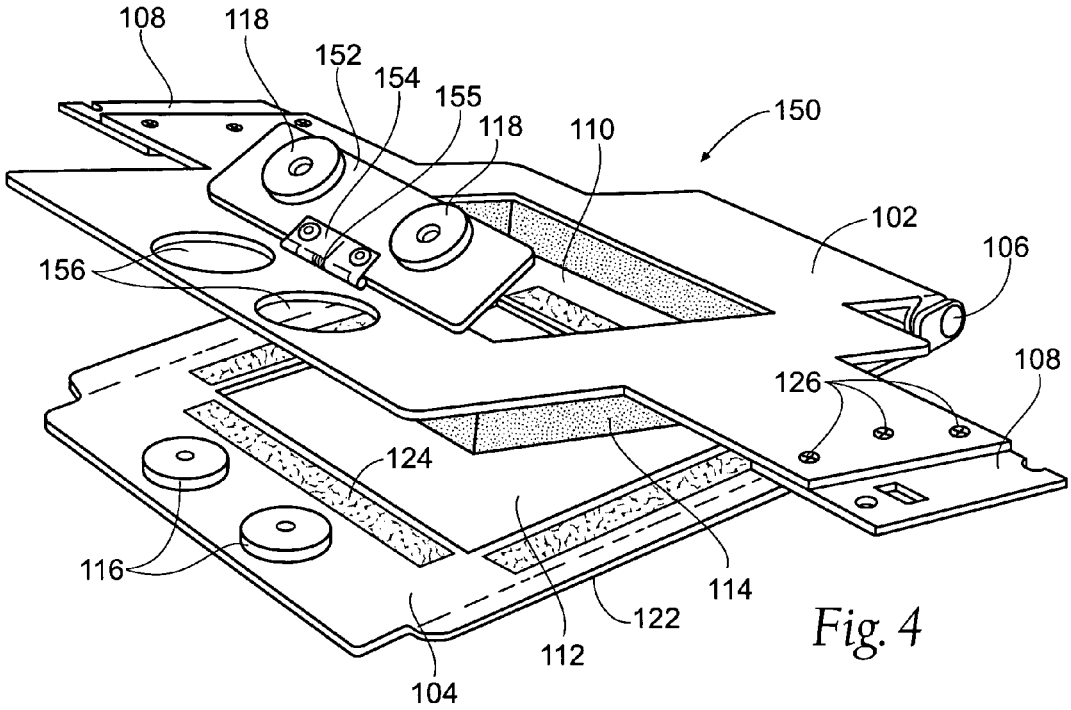
FIG. 4 shows another embodiment of a hooping device according to the present invention. This embodiment uses a different magnetic mechanism for holding the upper and lower clamping member together.

FIG. 4 shows a magnetic clamp 150 that is generally similar to the magnetic clamp 100 (shown in FIG. 3) except for the way that magnets 118 are mounted to the upper clamping member 102. Again, the upper clamping member 102 and lower clamping member 104 have a generally similar shape with an opening 110 in the upper clamping member and opening 112 in the lower clamping member being designed to mate when the members are biased together. These openings 110 and 112 form the area where the material to be embroidered will be situated. In this embodiment, the magnets 118 are mounted to a plate 152 that is attached by a hinge 154 to the top side of the upper clamping member 102. The hinge 154 is preferable biased away from the top side of the upper clamping member 102 by a spring 155 or similar biasing device. This bias makes the magnets 118 of the upper clamping member and magnets 116 of the lower clamping member not attract to each other until plate 152 is pivoted towards the top surface of the upper clamping member 102. This need to pivot the plate 152 allows for more control of the hooping process. It also allows the upper and lower clamping members to be pressed against the material to be embroidered slightly and the material adjusted before applying the magnetic holding force of the clamp. When plate 152 is pivoted, magnets 118 go through holes 156 in the upper clamping member and are attracted to magnets 116 in the lower clamping member. This ability to control the time of attraction between magnets 118 and 116 becomes more necessary when using more powerful magnets for hooping thicker items. When an item is removed from the clamp 150, the biased hinge 154 automatically rotates the plate 152 and magnets 118 away from the upper clamping member 102. The clamping member can be held in place on an embroidery machine (not shown) by way of oppositely disposed arms 108. The mounting arms 108 can be easily interchanged to fit different models of automated embroidery machines. Removable fasteners 126 hold mounting arms 108 to the main body of upper member 102. The simple changing of these disposed arms 108 can make the rest of the clamp universally fit many brands of embroidery machines. Again, it should be understood that any shape or design of an arm that will allow a hoop to be properly mounted to a machine will fall within the scope of the present invention.

The upper clamping member 102 also has a compressible type of material (such as foam rubber) 114 attached to the underside of the upper clamping member 102. This foam 114 is used to secure the material to be embroidered (not shown) between the upper clamping member 102 and the lower clamping member 104. This foam 114 is what allows the clamp to hold items with zippers, seams, and other uneven thicknesses. The lower member 104 could also be a shape that would align itself with a hoop holding bracket or device on a hooping board to assist in proper alignment of the hoop with an item to be embroidered. This alignment could also be accomplished by another method such as a pin in the hoop holding bracket and a corresponding hole in the lower clamping member 104, or the opposite (not shown). The lower clamping member 104 could also have pins or another locating means in it to hold it directly to a hooping board without the need for an additional bracket. A rubber gasket, sandpaper, or the like 124 could be placed on the upper surface of the lower clamping member 104 adjacent to opening 112 to provide added friction when securing pieces of material, but it is not necessary. The side edges 122 of the lower clamping member 104 can be bent slightly upward towards the upper clamping member 102 to help provide friction on the item to be secured in the clamp. These ridges also add strength to the lower clamping member 104.

Figure 5:
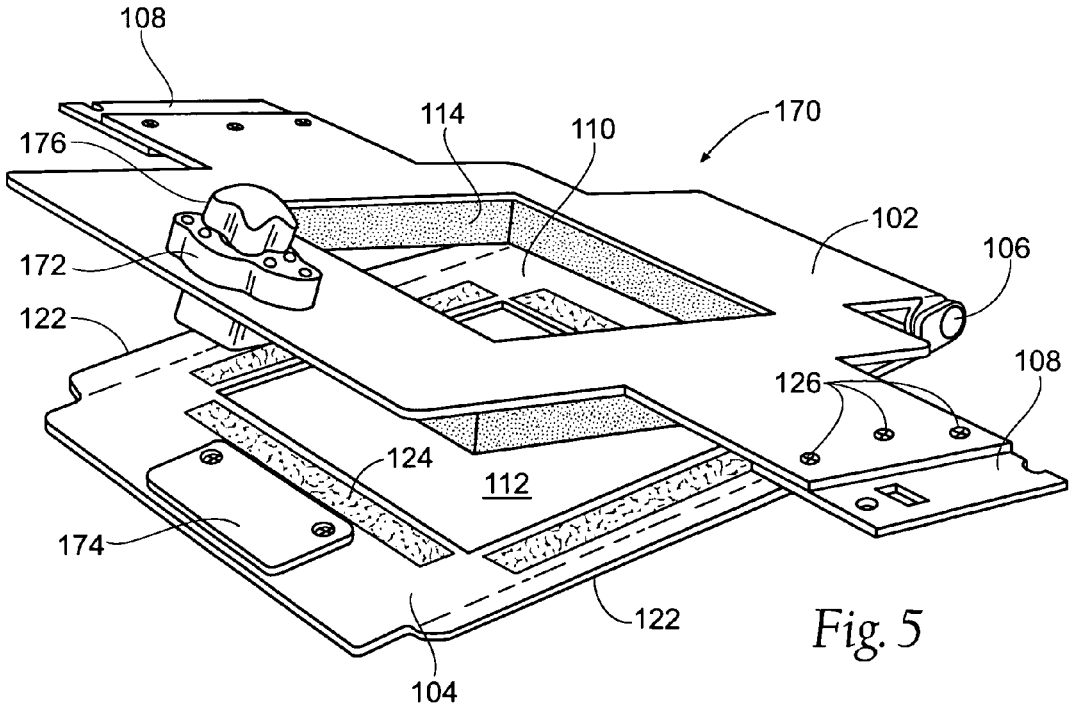
FIG. 5 shows another embodiment of a hooping device according to the present invention. This embodiment uses a different magnetic mechanism for holding the upper and lower clamping member together.

FIG. 5 shows a magnetic clamp 170 that is generally similar to the magnetic clamp 100 (FIG. 3) except for the way that the upper and lower clamping members are biased together. The upper clamping member 102 and lower clamping member 104 have a generally similar shape with an opening 110 in the upper clamping member and opening 112 in the lower clamping member being signed to mate when the members are biased together. These openings 110 and 112 form the area where the material to be embroidered will be situated. One or more of magnets 172 are mounted to the upper clamping member 102. Magnet 172 is a switchable magnet device similar to U.S. Pat. No. 6,707,360B2. The magnetic field of this magnet can effectively be turned on and off with knob 176. The lower clamping member 104 has a metal plate 174 mounted to its surface that is designed to be attracted to magnet 172 when the magnetic field is turned on. The advantage to this version of the magnetic clamp is that the magnetic field of the clamp can be completely controlled. Again, the clamping member can be held in place on an embroidery machine (not shown) by way of oppositely disposed arms 108. The mounting arms 108 can be easily interchanged to fit different models of automated embroidery machines. Removable fasteners 126 hold mounting arms 108 to the main body of upper member 102. The simple changing of these disposed arms 108 can make the rest of the clamp universally fit many brands of embroidery machines. It should be understood that any shape or design of an arm that will allow a hoop to be properly mounted will fall within the scope of the present invention.

The upper clamping member 102 also has a compressible type of material (such as foam rubber) 114 attached to the underside of the upper clamping member 102. This foam 114 is used to secure the material (not shown) between the upper clamping member 102 and the lower clamping member 104. This foam 114 is what allows the clamp to hold items with zippers, seams, and other uneven thicknesses. The lower member 104 could also be a shape that would align itself with a hoop holding bracket or device on a hooping board to assist in proper alignment of the hoop with an item to be embroidered. This alignment could also be accomplished by another method such as a pin in the hoop holding bracket and a corresponding hole in the lower clamping member 104, or the opposite (not shown). The lower clamping member 104 could also have pins or another locating means in it to hold it directly to a hooping board without the need for an additional bracket. A rubber gasket, sandpaper, or the like 124 could be placed on the upper surface of the lower clamping member 104 adjacent to opening 112 to provide added friction when securing pieces of material, but it is not necessary. The side edges 122 of the lower clamping member 104 can be bent slightly upward towards the upper clamping member 102 to help provide friction on the item to be secured in the clamp. These ridges also add strength to the lower clamping member 104.

Figure 6:
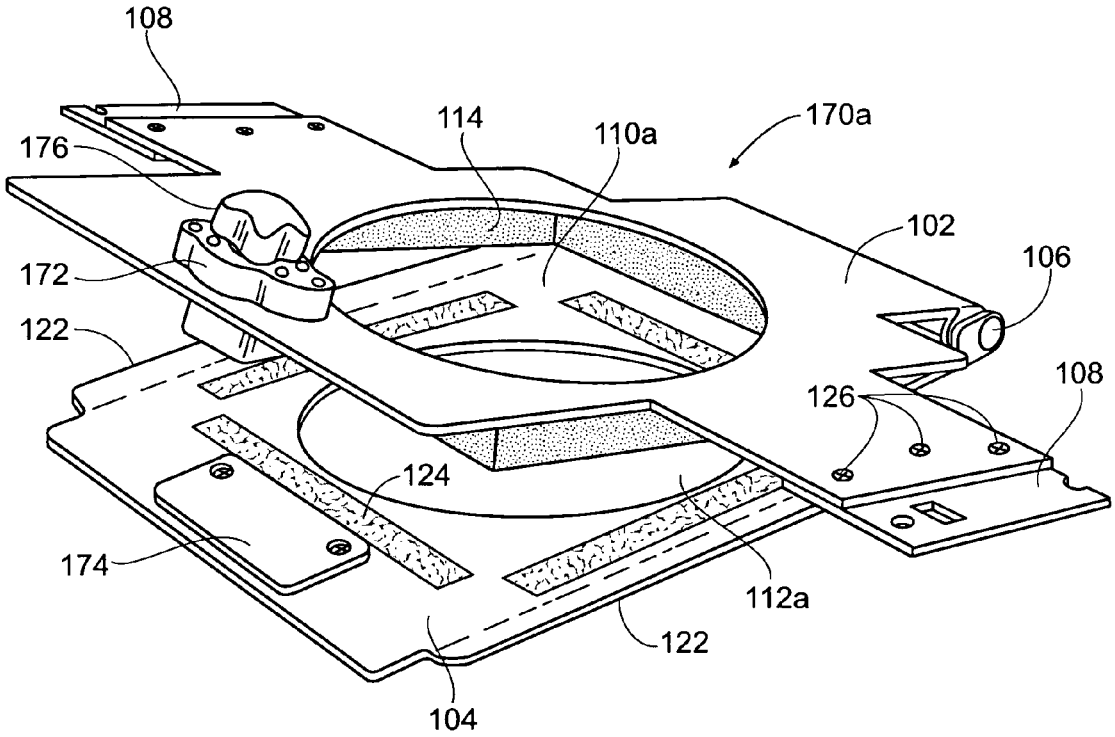
FIG. 6 shows another embodiment of a hooping device according to the present invention. This embodiment is very similar to FIG. 5 but illustrates a different size and shape embroidery area.

FIG. 6 provides an optional magnetic clamp 170A. The clamp 170A is generally similar to the clamp 170 (FIG. 5) having an upper clamping member 102 that defines an opening 110A, and a lower clamping member 104 that defines an opening 112A. The only difference between clamp 170 of FIG. 5 and 170A of FIG. 6 is that the openings 110, 110A and 112, 112A are a different size and shape. As shown in FIG. 6, the opening is circular in shape. As both FIGS. 5 and 6 demonstrate, the size and shape of the member as well as the number of magnets used can vary from one hoop to another and still fall within the scope of the present invention.

Figure 7:
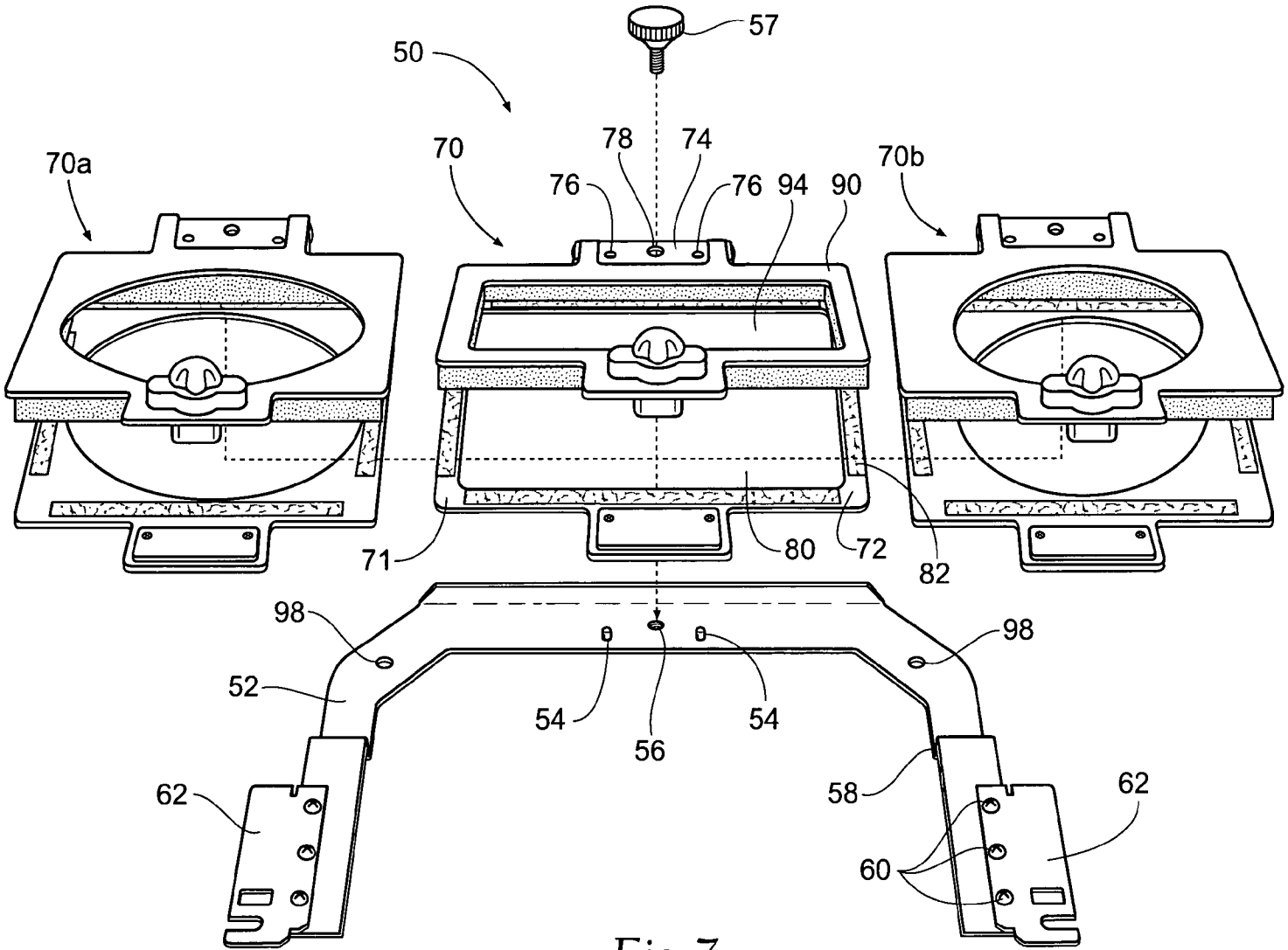
FIG. 7 is a perspective view of another embodiment of the present invention with interchangeable clamping members that are designed to be mounted to the main body of the device.
Figure 8:
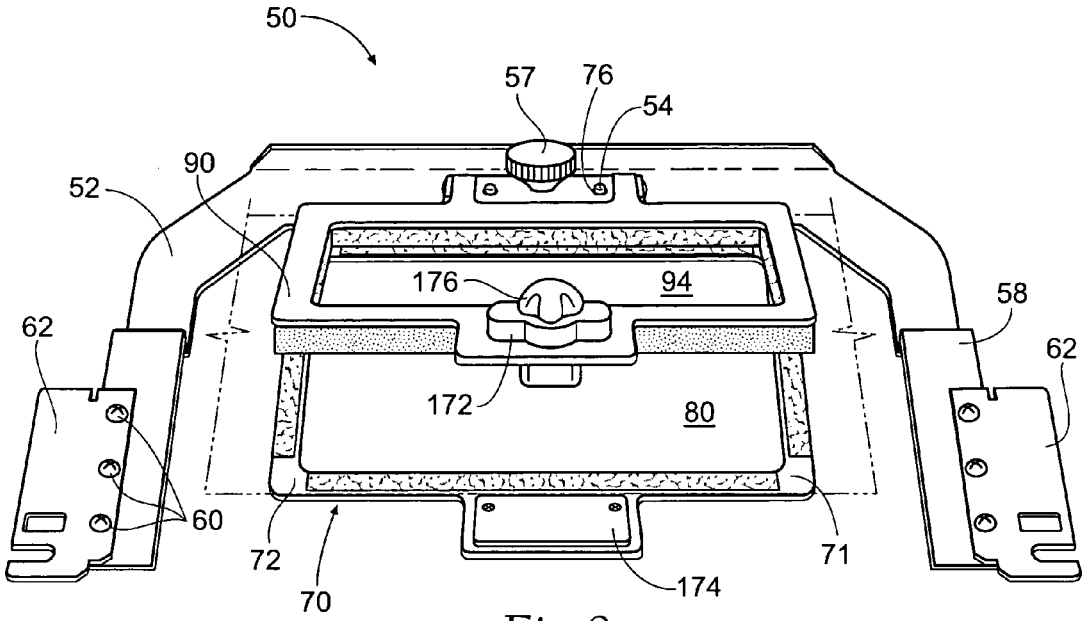
FIGS. 8 and 9 are perspective views similar to FIG. 7 but also show the lower clamping members mounted to the main body and the corresponding upper clamping member open prior to mating.
Figure 9:
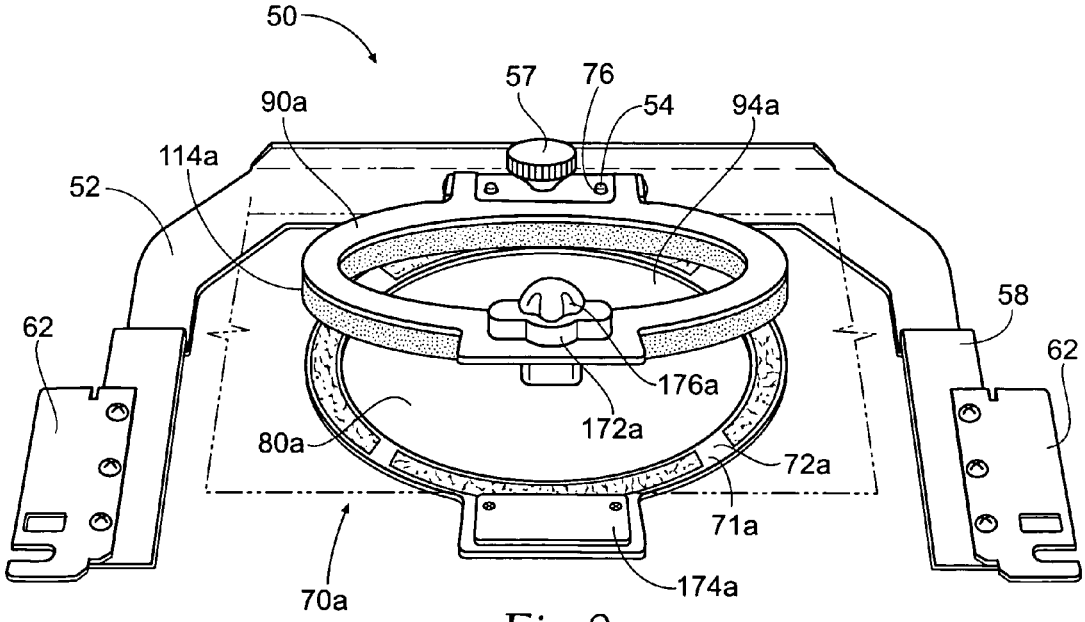

FIGS. 7 through 9 provide yet another embodiment 50 of a hoop according to the present invention. Hoop 50 comprises added features to help reduce the cost of producing different sizes of hoops needed for different applications. The hoop 50 comprises a main body 52 with interchangeable attachment arms 62 for mating with different brands of embroidery machines. Body 52 is also adaptable to mate with various sizes and shapes of interchangeable magnetic clamping members 70.

FIG. 7 is a perspective view of the main body 52 with one style of interchangeable attachment arms 62 and three exemplary clamping members 70 that can be attached. The body 52 can be held in place on an embroidery machine (not shown) by way of oppositely disposed mounting arms 62. The mounting arms 62 are attached to body 52 by screws 60 or similar fasteners that are easily removed. Mounting arms 62 can be easily interchanged to fit different models of automated embroidery machines. Mounting arms 62 will vary in configuration, shape, and form of mating engagement from one model of embroidery machine to another. This allows the hoop 50 to have one standard body 52 that can be adapted to fit different brands of embroidery machines. The main body 52 may require a step-up portion 58 to allow the lower member 71 of clamping member 70 to be a little below the level of the mounting arms 62. This is to allow the clamping member 71 to be at the level of the needle plate 36 (see FIG. 2) of the embroidery machine (not shown), while the mounting arms 62 are at the level of the embroidery frame receiving arms on the embroidery machine (not shown). Openings 98 may be provided in body 52 to receive pins or other locating devices commonly found on hooping devices, such as hooping boards.

To provide the mating capability between body 52 and clamping member 70, at least one alignment pin 54 and one threaded hole 56, or other type of suitable fastening means, are formed on the upper surface of body 52. Lower clamping member 71 includes an integrally-formed mounting portion 74 and a main body 72. The lower clamping member 71 forms an opening 80 that is designed to mate with opening 94 of the upper clamping member 90 and provides an area where the material to be embroidered will be situated. A non-slip material such as a rubber gasket, sandpaper, or the like 82 could be attached to the top surface of lower member 71 to provide added friction when securing pieces of material, but it is not necessary. Holes 76 in mounting portion 74 are made to engage with the pins 54 formed in the upper surface of body 52 to align clamping member 70 with body 52. Hole 78 is formed in the free edge of mounting portion 74 and is designed to mate with hole 56 of the main body 52. Once holes 76 and 78 are aligned with pins 54 and threaded hole 56, thumb screw 57 is placed through hole 78 and into threaded hole 56. Fastener 57 is then rotated in a conventional manner to place pressure on the mounting portion 74 of clamping member 70, securing clamping member 70 to body 52. When it is necessary to change to a different size or shape clamping member, only thumb screw 57 has to be removed and then the clamping members can be removed and replaced with a new size or shape clamping member 70.

FIG. 8 shows another embodiment of the present invention with a clamp 70 attached to body 52.

FIG. 9 continues to illustrate, but is not exhaustive, of a different shape and size clamping member 70A that can be mounted to body 52. The clamping members 70 in FIGS. 8 and 9 are made with the same type of switchable magnet 172 as in FIG. 5, but it should be understood that the arrangement of magnets for biasing the upper and lower members together from FIG. 3 or 4 could also be used and still fall within the scope of this embodiment. Member 90A is relatively the same size and shape as its matching member 71A.

Figure 10:
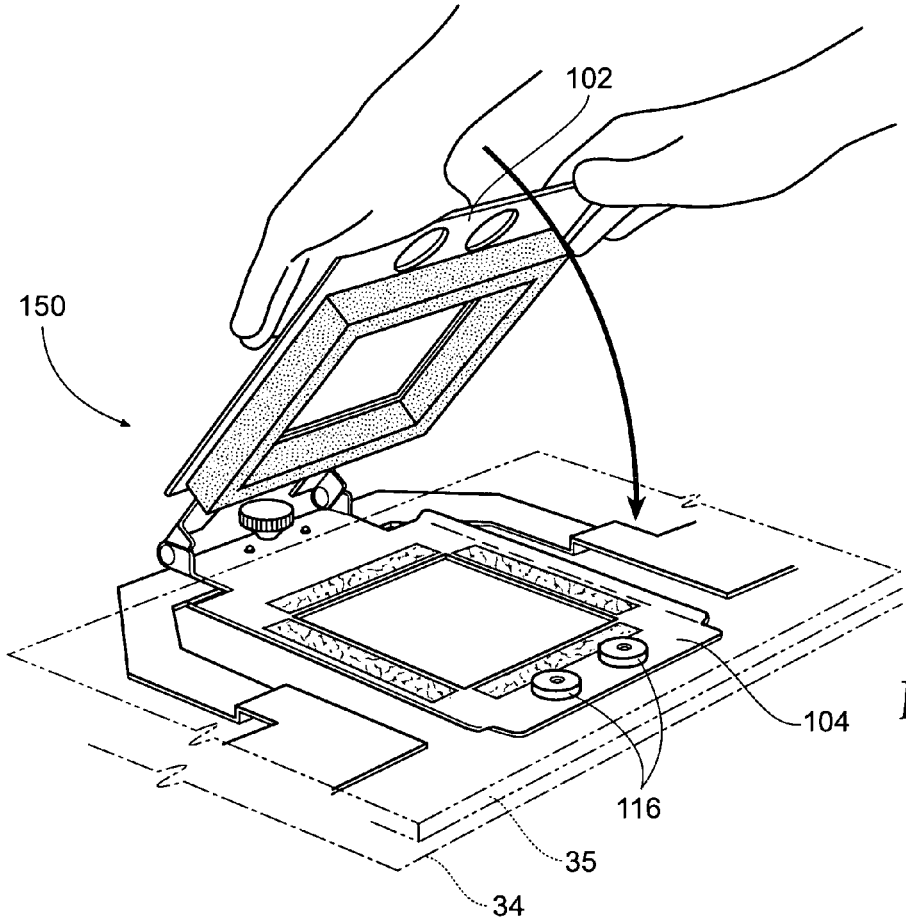
FIG. 10 is a perspective view of the hooping device with the garment and backing sheet placed between the open upper and lower clamping members.

In FIG. 10, the embroidery backing material 34 and material to be embroidered 35 (garment) is placed upon the lower clamping member 104. Once the material 35 is close to being properly situated, the upper clamping member 102 is pressed towards the backing material 34, material to be embroidered 35, and clamping member 104. At this point the upper and lower clamping members are not attracted to one another with enough force to hold the material. This allows the user to adjust or reposition the material 35, if necessary, without the magnets 116 and 118 drawing towards one another.

Figure 11:
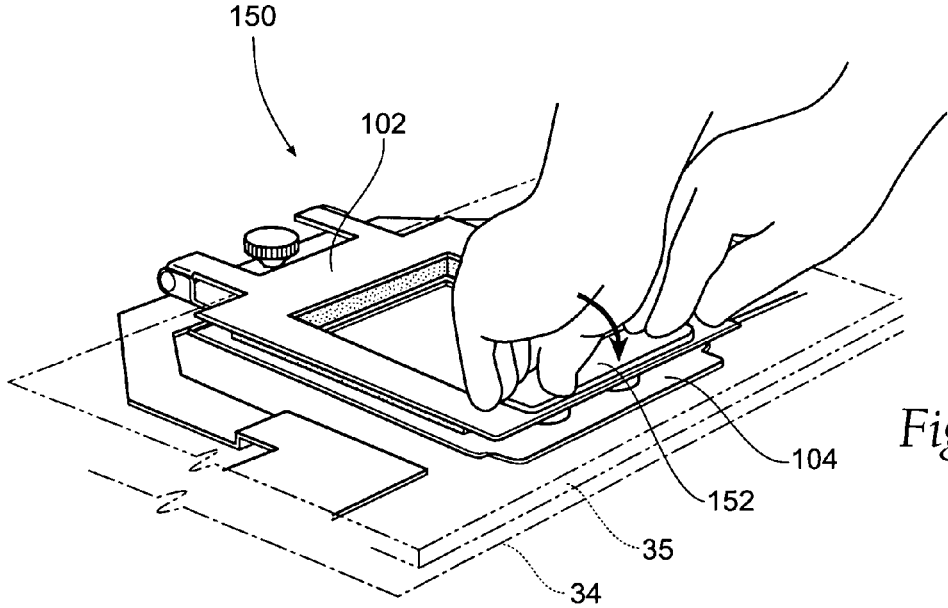
FIG. 11 is a perspective view of the hooping device being closed to secure the garment and backing sheet.

Now referring to FIG. 11, once the material 35 is properly positioned, the spring biased plate 152 on the upper clamping member 102 can be pivoted towards the lower clamping member 104, thereby securely retaining the material 35 and backing material 34 within the hoop 150 as with the previous embodiments.

The present invention provides a hoop used with embroidery machines that is easy to apply to garments and align during the hooping process.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention.

We claim:

1. A device for use with a pantograph of an embroidery machine selected from a variety of different embroidery machines to embroider on a piece of material, said device comprising:

a first hooping member defining a first opening;

a second hooping member defining a second opening;

said first and second hooping member being hingedly connected to each other;

one of said first and said second hooping members including at least one magnet affixed thereto;

the other of said first and said second hooping members comprising a material to attract the magnet of the other of said hooping members;

compressible material being affixed to one of said first and second hooping members around at least a portion of its respective opening to removably secure said material;

a first mounting arm adapted to receive one of said first and second hooping members and said selected embroidery machine pantograph;

said first mounting arm being interchangeable with a second mounting arm for attachment to a pantograph of another embroidery machine selected from said variety of different embroidery machines;

one of said first and said second hooping members being releasably attached to a first end of said first mounting arm; and a second end of the first mounting arm configured for releasably attaching with the pantograph of the selected embroidery machine.

2. The device according to claim 1, wherein each of said first and said second hooping members include at least one magnet.

3. The device according to claim 1, wherein the other of said first and said second hooping members comprises a metal material.

4. The device according to claim 1, wherein said at least one magnet comprises a rare earth magnet.

5. The device according to claim 1, wherein one of said first and said second hooping members comprises a locating feature for aligning said first or said second hooping member with a hooping device.

6. A device for use with a pantograph of an embroidery machine selected from a variety of different embroidery machines to embroider on a piece of material, said device comprising:

a first hooping member defining a first opening;

a second hooping member defining a second opening;

said first and second hooping member being hingedly connected to each other;

one of said first and said second hooping members including at least one opening formed therein, a pivotal plate being mounted adjacent said opening, and at least one magnet being mounted to said plate;

the other of said first and said second hooping members comprising a material to attract the at least one magnet of the other of said hooping members;

a first mounting arm adapted to receive one of said first and second hooping members and said selected embroidery machine pantograph;

said first mounting arm being interchangeable with a second mounting arm for attachment to a pantograph of another embroidery machine selected from said variety of different embroidery machines;

one of said first and said second hooping members being releasably attached to a first end of said first mounting arm; and a second end of the first mounting arm configured for releasably attaching with the pantograph of the selected embroidery machine.

7. The device according to claim 6, wherein each of said first and said second hooping members include at least one magnet.

8. The device according to claim 6, wherein the other of said first and said second hooping members comprises a metal material.

9. The device according to claim 6 further including compressible material, said compressible material being affixed to one of said first and second hooping members around at least a portion of its respective opening.

10. The device according to claim 6 further including frictional material, said frictional material being affixed to one of said first and second hooping members around at least a portion of its respective opening.

11. The device according to claim 6, wherein said at least one magnet comprises a rare earth magnet.

12. The device according to claim 6, wherein one of said first and said second hooping members comprises a locating feature for aligning said first or said second hooping member with a hooping device.

13. A device for use with a pantograph of an embroidery machine selected from a variety of different embroidery machines to embroider on a piece of material, said device comprising:

a first hooping member defining a first opening;

a second hooping member defining a second opening;

said first and second hooping member being hingedly connected to each other;

wherein one of said first and said second hooping members includes at least one switchable magnet mechanism affixed thereto;

wherein the other of said first and said second hooping members comprises a material to attract the switchable magnet mechanism of the other of said hooping members;

a first mounting arm adapted to receive one of said first and second hooping members and said selected embroidery machine pantograph;

said first mounting arm being interchangeable with a second mounting arm for attachment to a pantograph of another embroidery machine selected from said variety of different embroidery machines;

one of said first and said second hooping members being releasably attached to a first end of said first mounting arm; and a second end of the first mounting arm configured for releasably attaching with the pantograph of the selected embroidery machine.

14. The device according to claim 13, wherein the other of said first and said second hooping members comprises a metal material.

15. The device according to claim 13 further including compressible material, said compressible material being affixed to one of said first and second hooping members around at least a portion of its respective opening.

16. The device according to claim 13 further including frictional material, said frictional material being affixed to one of said first and second hooping members around at least a portion of its respective opening.

17. The device according to claim 13, wherein one of said first and said second hooping members comprises a locating feature for aligning said first or said second hooping member with a hooping device.

* * * * *